United States Patent [19]

DiSesa

[11] Patent Number: 4,819,827

[45] Date of Patent: Apr. 11, 1989

[54] REFUSE CONTAINER WITH LOCKING HANDLE

[75] Inventor: Frank DiSesa, Lunenburg, Mass.

[73] Assignee: Kidde Holding, Inc., Saddle Brook, N.J.

[21] Appl. No.: 109,476

[22] Filed: Oct. 16, 1987

[51] Int. Cl.[4] ..... B65D 45/00

[52] U.S. Cl. ..... 220/318; 220/1 T

[58] Field of Search ..... 220/1 T, 315, 318

[56] References Cited

U.S. PATENT DOCUMENTS

| | | | |
|---|---|---|---|
| 3,080,996 | 3/1963 | Graham | 220/318 |
| 3,416,701 | 12/1968 | Kramer et al. | 220/318 |
| 3,471,054 | 10/1969 | Ostrowsky et al. | 220/318 |
| 3,817,563 | 6/1974 | McGlothlin | 220/318 |
| 4,279,357 | 7/1981 | Robinson | 220/318 |
| 4,691,840 | 9/1987 | Ferbrache | 220/318 |

*Primary Examiner*—Joseph Man-Fu Moy

*Attorney, Agent, or Firm*—Darby & Darby

[57] ABSTRACT

A refuse container includes a container body, lid and a pair of U-shaped handles affixed to the container body. A pair of protrusions are included on upper portions of opposite sides of the container body. Each protrusion has a corresponding hollowed portion inside the container, has openings on opposite sides and has an irregular cross-sectional shape. A camming element is inserted in each protrusion. Each camming element has camming portions with an irregular shape corresponding to that of the cross-sectional shape of the protrusion. The camming elements have keyed slots on either side. Each handle has a pair of opposing projections which include an axle portion and a keying portion. The projections extend through the openings of the container protrusion with the keying portion extending into the keyed slots of the camming elements. Each handle is adapted to being locked in a substantially vertical position by alignment of irregularities of the camming element and protrusion and adapted to being freely rotatable in other positions. Each handle also has a pair of projections facing inward to the container so as to cooperate with the annular recess of the lid when the handle is in a locked position and the lid is on the container for latching the lid to the container.

13 Claims, 3 Drawing Sheets

REFUSE CONTAINER WITH LOCKING HANDLE

BACKGROUND OF THE INVENTION

1. Field of the Invention

The present invention relates to refuse containers and, in particular, refuse containers with locking handles.

2. Background of the Prior Art

It is known to provide garbage cans or refuse containers with lids which latch onto the container. This is done to prevent animals from getting at the refuse and, also, to seal odors in the can until the can is emptied. U.S. Pats. Nos. 2,873,880 and 2,835,407 illustrate two prior art attempts to combine a garbage can handle with a latching member.

It is also known to provide garbage cans with a pair of handles on opposite sides of the containers for lifting the container and to provide a lid or cover which latches or snaps onto the container. An example of such structure is shown in U.S. Pat. No. 4,390,110.

Garbage cans have also been commercially available which have movable handles which lock in a particular position. Another type of refuse container which has been commercially available includes a handle affixed to the container which serves to clamp the lid on the container.

When garbage cans are manufactured from plastic such as by blow molding or injection molding techniques, a mechanism which provides a repeatable and reliable locking feature has been difficult to achieve.

None of the various types of containers previously known provide a construction which is simple in design but which also provide movable handles which reliably lock in place and which also serve to clamp or latch the lid on the refuse container. An object of the present invention is the provision of a refuse container which overcomes the various deficiencies of the prior art. Another object of the present invention is the provision of a refuse container having the above features in which the body, handle and lid of the container can be manufactured by a blow molding or injection molding process.

SUMMARY OF THE INVENTION

In accordance with the present invention, a refuse container comprises a container body and a lid having a recess, the lid for covering the container body. Mounting means are included which are affixed to the container body. A handle is rotatably mounted in the mounting means, the handle being freely rotatable between a first downward position and a second upward position. Means are also included forming part of the mounting means and part of the handle for locking the handle in a third upward position where the handle is approximately parallel to the outside of the container. Means form part of the handle for cooperating with the recess of the lid for latching the lid when the handle is in a locked position.

For a better understanding of the present invention, reference is made to the following description and accompanying drawings, while the scope of the present invention will be pointed out in the appended claims.

DESCRIPTION OF THE PREFERRED EMBODIMENTS

Figure 1:
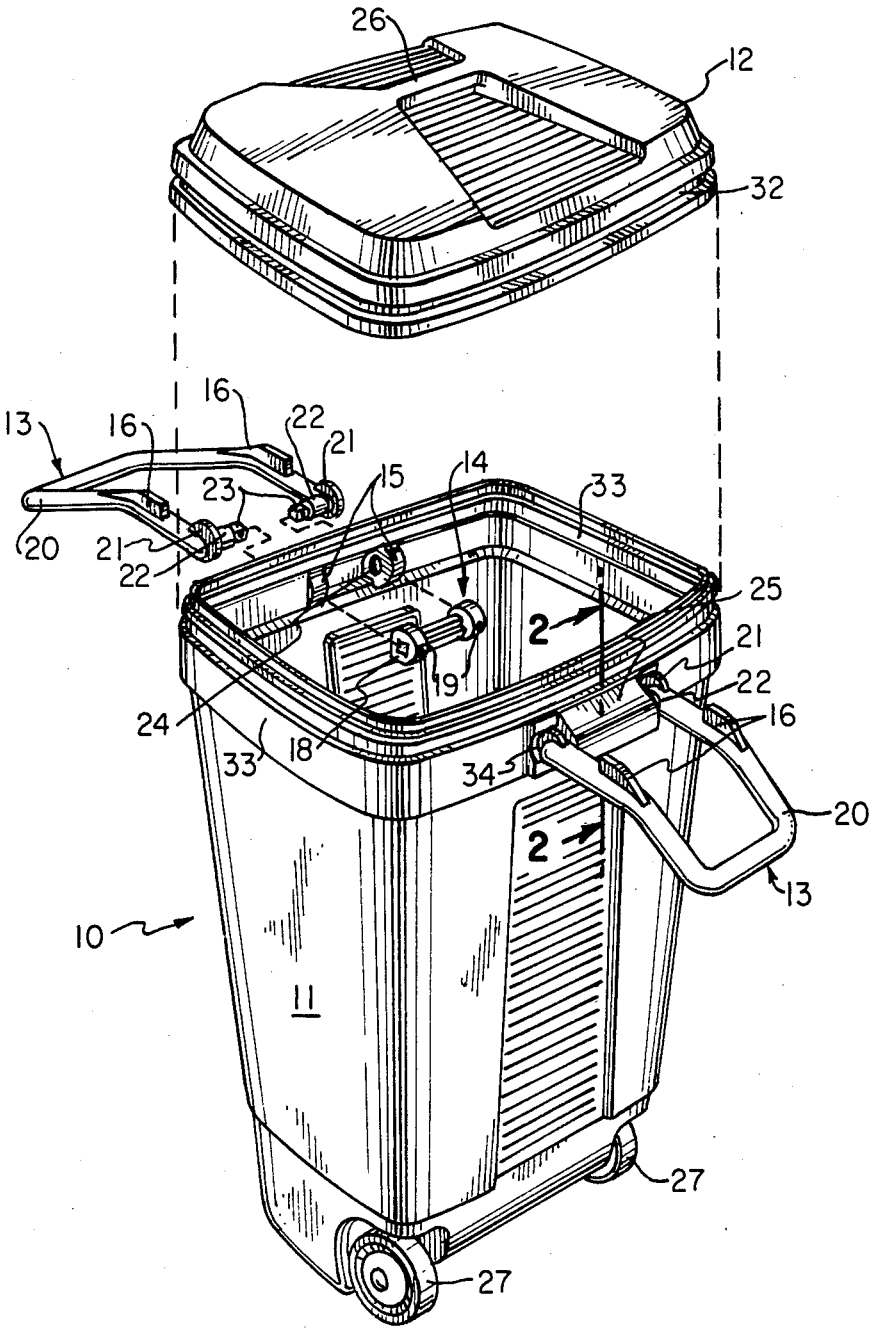
FIG. 1 is a three-dimensional perspective view of a refuse container in accordance with the invention.

Referring initially to FIG. 1, shown there is a refuse container 10 having a body 11 and a lid 12. The body and lid preferably have a generally rectangular cross-section although other cross-sectional configurations may readily be utilized. The lid is constructed to slide over the top portion of the container body to provide a fairly tight fit. Annular grooves may be provided in the lid and in the upper portion of the container body to allow the lid to snap onto the container body. The lid includes an integral cover handle 26.

A pair of handles 13 are mounted near the top portion of opposing side walls of the container body. Each handle 13 includes a U-shaped upper portion 20, lid clamping projections 16 and rotating axle means comprising swivel element 21, cylindrical axle 22 and keyed projection 23. Each handle 13 is mounted in a container protrusion 25 so as to be rotatable. The means allowing the handle to rotate and lock will be described further below. The handle 13 is allowed to rotate between a downward position approximately parallel to the outer surface of the container (further downward rotation will be prevented by the side surface of the container) and an upward position which is near to the vertical when the container is standing upright as shown. In a position still further upward, the handle will lock as will be described in greater detail below.

Each handle 13 is held in place by means of a spindle element 14. Spindle 14 includes a shaft 17 and camming portions 19. Within camming portions 19 are keyed openings 18 into which keyed projections 23 of the handle are inserted. In the area of protrusion 25, internal to the container, are spindle retainer elements 15 having opening 24 therein.

In assembly, the spindle 14 is placed within spindle retainer elements 15 and the opening 24 is aligned with keyed spindle openings 18. The lower legs of the U of the handle are then spread apart (the handle, being plastic, having sufficient resiliency) and placed so that keyed projections 23 align with keyed spindle openings 18. The force on the handle legs is released and the handle legs will be seated on the spindle 14 and ready for rotation. Note that the lid clamping projections 16 face inwardly toward the container body.

Figure 2:
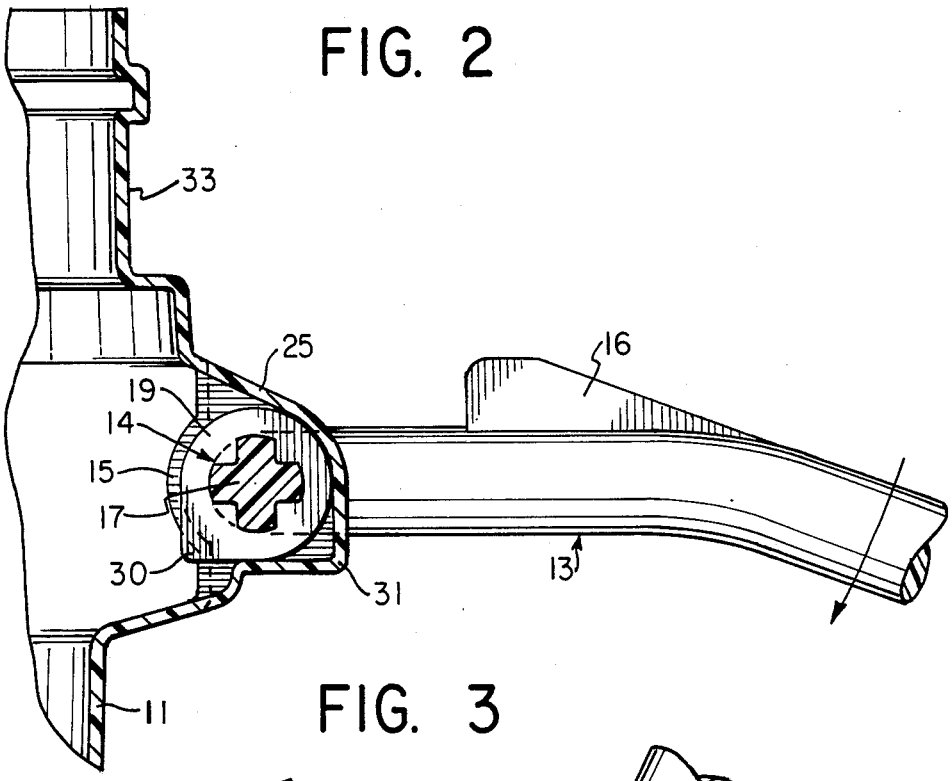
FIG. 2 is a partial side sectional view along 2—2 of FIG. 1 of the handle mechanism of the present invention with the handle in an unlatched position.
Figure 3:
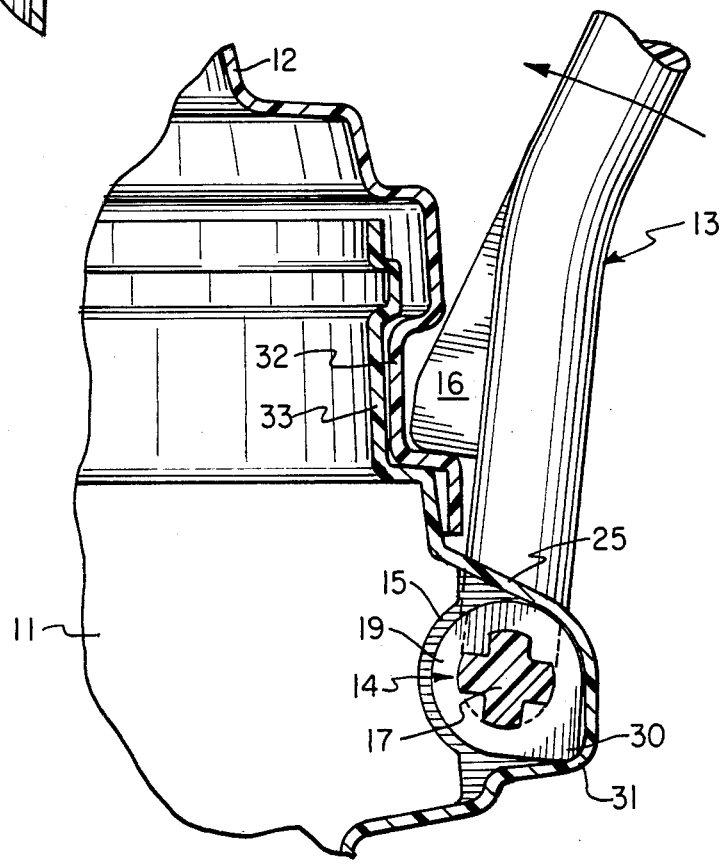
FIG. 3 is a side sectional view along the same 2—2 plane showing the handle in a position which is both locked and wherein the cover is clamped.

Referring now to FIGS. 2 and 3, the handle is shown in a rotating position (FIG. 2) and a locked position (FIG. 3). In these figures, protrusion 25 is seen to have an arcuate cross-section in its upper portion and a generally right angle cross-section in its lower portion. Each camming element 19 has a generally circular cross-section except for a shoulder portion 30 which is right angled in shape.

In FIG. 2, the handle is free to rotate downwardly since the circular cross-sectional shape of the camming elements corresponds to the arcuate cross-sectional shape of the protrusion. When the handle is rotated upwardly, at about 45 degrees to the vertical, the shoulder portion 30 of the camming element will begin to press on the lower part of protrusion 25 so as to distort it. Further upward rotation will cause greater distortion until the handle arrives at the vetical position—FIG. 3. In this vertical position, cam shoulder 30 rests within the correspondingly shaped portion 31 of protrusion 25. This is considered the locked position since substantial force must be exerted to again deform the projection 25 so as to allow the handle to freely rotate. In this locked position, handle projection 16 will rest within annular groove 32 of the cover which, in turn, is arranged within annular groove 33 of the upper portion of the container. This clamps the cover in place.

Figure 4:
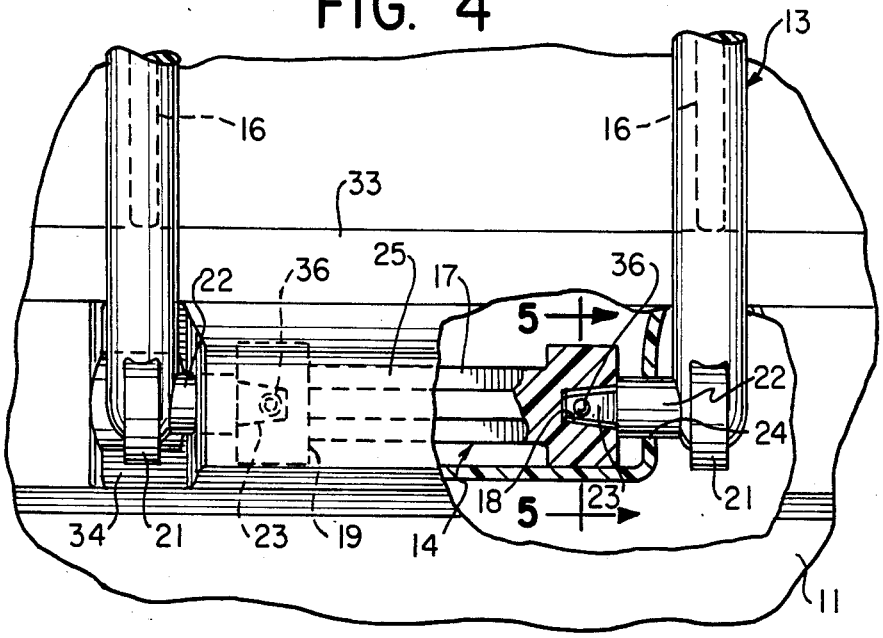
FIG. 4 is a frontal view of the handle of the refuse container partially broken away.
Figure 5:
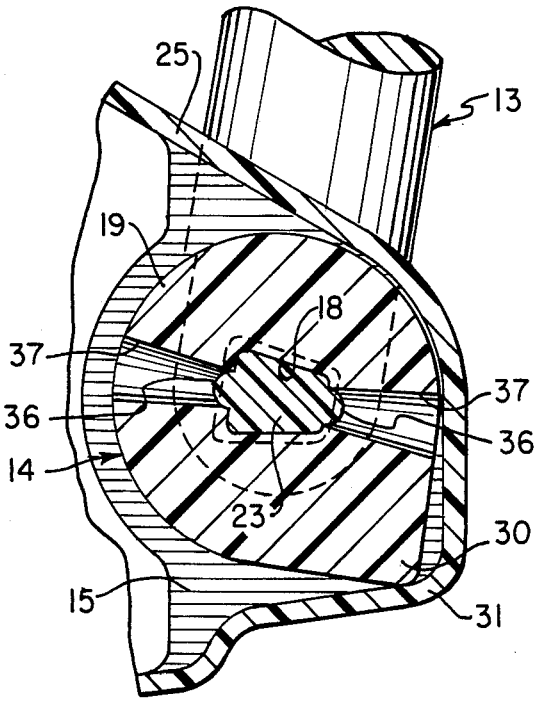
FIG. 5 is a side view of the handle taken along 5—5 of FIG. 4.

Referring to FIGS. 4 and 5, in order to prevent the applied handle rotational force from "stripping" the keying arrangement, additional button projections 36 are arranged on the keying projection 23. These button projections interfit with shafts 37 in the cam elements which act as a recess for them.

The handle 13 also includes swivel elements 21 which, together with handle guide 34 next to the protrusion 25 on the container, permit smooth rotation of the handle.

The container also includes wheels 27. With the handle either in locked position or not, the container is readily wheeled by pulling on the handle over the wheels and tilting the container.

It is also within the scope of the invention to apply the inventive approach to a refuse container without wheels. Further, the refuse container may have a rounded (or other geometric shaped) cross-section in lieu of the depicted arrangement.

While the foregoing description and drawings represent the preferred embodiments of the present invention, it will be obvious to those skilled in the art that various changes and modifications may be made therein without departing from the true spirit and scope of the present invention.

What is claimed is:

1. A refuse container comprising:

a container body of a deformable material with a vertical side wall defining a central opening at the top thereof;

a removable lid for fitting on the top of said side wall to cover said central opening;

a hollow protrusion formed on said side wall and extending outwardly therefrom, said protrusion having an irregular internal cross-sectional shape;

at least one locking element in said hollow protrusion having portions with an irregular shape generally corresponding to that of said protrusion internal cross-sectional shape;

a generally U-shaped handle;

means at the end of each arm of said handle for extending into said protrusion to engage and rotate said locking element as said handle is rotated;

said handle being locked in a substantially upright vertical position by alignment of the correspondingly shaped irregularities of said locking element and protrusion internal cross-section, said locking element entering and leaving a locked position when the handle is locked by moving over, deforming, and releasing a part of said protrusion;

and a finger extending from each arm of the handle to overlie the periphery of the lid when the handle is in the upright vertical locked position.

2. The refuse container of claim 1, wherein said means for rotating said locking element includes a keyed slot on each side thereof, an axle means within said hollow protrusion connected to and rotated by said handle and including keyed projections for insertion in said keyed slots of said locking element.

3. The refuse container of claim 2, wherein said protrusion includes openings at ends thereof, said keyed projections of said handle axle extending for insertion into said keyed slots of said locking element through the openings of said protrusion so as to hold said locking element.

4. The refuse container of claim 3, wherein said locking element has a shaft and an irregularly shaped element at each end thereof.

5. The refuse container of claim 1, wherein the irregularities have a predominantly cylindrical shape with one portion being substantially at a right angle to another portion, wherein, when said irregularities are in alignment, the handle is substantially in the vertical position and locked.

6. The refuse container of claim 5 wherein said container is constructed from flexible plastic to allow the handle to enter and come out of the locked position.

7. The refuse container of claim 6, wherein said container includes guide means adjacent to said protrusion and wherein said handle has elements which cooperate with said guide means to ensure smooth rotation of said handle when said handle is not in a locked position.

8. The refuse container of claim 1, wherein there are a pair of said protrusions and each with a corresponding handle located on opposite sides of the container body vertical wall.

9. The refuse container of claim 1, wherein said container, handle and lid are made of plastic material.

10. The refuse container of claim 1, wherein said container body and lid are produced by blow molding and wherein said handle and locking elements are produced by injection molding.

11. The refuse container of claim 1, including a pair of wheels at the bottom of the container body.

12. The refuse container of claim 8, wherein the irregularities have a predominantly cylindrical shape with one portion being substantially at a right angle to another portion, wherein when said irregularities are in alignment, the handle is substantially in the vertical position and locked.

13. The refuse container of claim 12 wherein said container is constructed from flexible plastic to allow the handle to enter and come out of the locked position.

* * * * *